United States Patent [19]

Anderson et al.

[11] 4,294,709

[45] Oct. 13, 1981

[54] SPIN FINISH WITH ANTI-STATIC AGENT

[75] Inventors: Norman Anderson, Matthews, N.C.; Richard Peak; James A. Moyse, both of Manchester, England

[73] Assignee: Imperial Chemical Industries Limited, London, England

[21] Appl. No.: 110,994

[22] Filed: Jan. 10, 1980

[30] Foreign Application Priority Data

Jan. 26, 1979 [GB] United Kingdom ..... 02933/79
Jun. 4, 1979 [GB] United Kingdom ..... 19385/79

[51] Int. Cl.[3] ..... D06M 15/42; D06M 13/46; D06M 15/00

[52] U.S. Cl. ..... 252/8.8; 264/210.3; 264/136

[58] Field of Search ..... 252/8.8 R; 264/136, 264/210.3

[56] References Cited

U.S. PATENT DOCUMENTS

| | | | |
|---|---|---|---|
| 3,164,650 | 1/1965 | Kocay et al. | 264/130 |
| 3,723,173 | 5/1973 | Schonfeldt | 252/8.8 |

FOREIGN PATENT DOCUMENTS

| | | | |
|---|---|---|---|
| 2642517 | 3/1978 | Fed. Rep. of Germany | 252/8.8 |
| 47-40600 | 10/1972 | Japan | 264/136 |
| 48-33436 | 10/1973 | Japan | 252/8.8 |
| 52-63496 | 5/1977 | Japan | 264/210.3 |

*Primary Examiner*—Joseph L. Schofer
*Assistant Examiner*—Maria Parrish Tungol
*Attorney, Agent, or Firm*—Cushman, Darby & Cushman

[57] ABSTRACT

A spin finish composition for textile fibre or yarn including a lubricant and antistatic agent, optionally an additional emulsifier and an antioxidant, in which the antistatic agent is an N,N′-dialkylamino alcohol alkoxylate. The finish is less prone to coking of heater plates in yarn texturing machines.

4 Claims, No Drawings

SPIN FINISH WITH ANTI-STATIC AGENT

This invention relates to a spin finish, its composition and use, and in particular to a spin finish containing an antistatic agent for conferring antistatic properties on a treated fibre or yarn.

In the processing of fibres and yarns in the textile producing industries it is usual to apply to the yarn a spin finish to facilitate mechanical handling. This spin finish comprises lubricants, emulsifiers, antioxidants and antistatic agents.

Innumerable compositions have been proposed for these general purposes. In an aqueous emulsion, the active ingredients are a mineral oil or ester, emulsifier system and other additives for antistatic or antioxidant effects.

One of the known compositions most relevant to the present invention is described in Japanese patent publication 1975 0090-794, Derwent No 85485 W (Toyobo K. K.). Ethylene diamine is reacted with ethylene oxide and propylene oxide to form a surfactant which is incorporated into a finish with mineral oil, non-ionic surfactants, anionic surfactants and lauryl alcohol. The advantage is increased coherence of the yarn fibres. In U.S. Pat. No. 3,723,173, there is described the treatment of fibres with propylene oxide-ethylene oxide adducts of amines, including polyalkyl polyamines, to improve strength and elongation and reduce static electricity build-up.

The most closely related finishes known to us are those which include poly(ethylene oxide) adducts of soya amines which have been quaternised with diethyl sulphate or dimethyl sulphate. These give satisfactory antistatic performance, but with a tendency towards faster yarn speeds, heater plate surfaces are run at correspondingly high temperatures during texturing and the commercially available products tend to coke. This phenomenon of coking accurs when the finish transfers to the heater plate and decomposes leaving a deposit of carbon. Build-up of this deposit necessitates shut down of the machine for cleaning, as it contaminates the yarn and adversely effects the heat transfer characteristics of the plate surface.

To overcome this problem we have now devised a spin finish composition based on alkylene oxide adducts of quaternary ammonium compounds which provide an antistatic finish which has less tendency to coking through decomposition at high temperatures.

Our invention provides a spin finish oil, capable of emulsification and dilution in water, comprising:

A: a lubricant of known type for spin finishes;

B: an antistatic agent of the general formula:

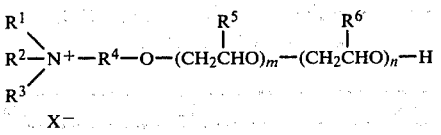

$$R^2(R^1)(R^3)N^+-R^4-O-(CH_2\underset{\displaystyle R^5}{\underset{|}{C}}HO)_m-(CH_2\underset{\displaystyle R^6}{\underset{|}{C}}HO)_n-H \quad X^-$$

where:

$R^1$ and $R^2$, which may be same or different, are alkyl groups containing up to six carbon atoms;

$R^3$ is an alkyl group containing up to twelve carbon atoms;

$R^4$ is an alkylene group containing up to ten carbon atoms;

$R^5$ and $R^6$ are hydrogen or methyl;

m and n are integers from 0 to 60, provided that either m or n is at least 1 and where $R^5$ and $R^6$ are different, the poly alkylene oxide units are in block or random copolymer relationship and further provided that at least one propylene oxide unit is always present; X is an anion.

In addition there may be present:

C: an emulsifier for the lubricant to assist aqueous emulsification;

D: an antioxidant;

Each of the component A to D will now be considered in greater detail;

The lubricant A is of known type or is a mixture of known types such as mineral oils, esters or an emulsifiable or self emulsifiable lubricant such as an ethylene oxide/propylene oxide copolymer.

A typical mineral oil would have a viscosity of 10–15 centistokes at 37° C. and specific gravity of 0.83–0.88 at 18° C.

Esters are exemplified by butyl stearate, isooctyl stearate, tridecyl stearate, hexadecyl stearate, trimethylol propane trilaurate and pelargonic acid esters of trimethylol propane and pentaerythritol.

Typical emulsifiable or self emulsifiable lubricants of the ethylene oxide/propylene oxide copolymer type are exemplified by ethylene oxide capped polypropylene glycols and ethylene oxide/propylene oxide random copolymers.

The antistatic agent (B) gives the advantages to the spin finish according to the invention and will be discussed in greater detail.

$R^1$ and $R^2$ are preferably lower alkyl groups containing up to six carbon atoms in straight or branched chains.

$R^3$ is preferably a lower alkyl group containing up to twelve carbon atoms or benzyl or substituted benzyl $R^3$ is more preferably methyl or ethyl, though these are selected on the basis of commercial availability of precursors rather than technical considerations.

$R^4$ is preferably an alkylene group containing up to ten carbon atoms.

X is preferably alkoxy sulphate, chloride, bromide, iodide, acetate, tartrate, borate, sulphate, or phosphate.

It is believed that it is the introduction of propylene oxide units into the antistatic agent that reduces coking tendencies during use. No propylene oxide, as shown in comparative tests later, gives no advantage. While it is possible to prepare compounds containing no ethylene oxide, these are sometimes not compatible with other components and form unstable emulsions. Such compound need therefore to be tested on a small scale before use. Values of m and n are preferably selected to give molar ratios of ethylene oxide to propylene oxide (EO:PO) of 1:4 to 4:1. More preferably a range of 1:2 to 2:1 is favoured.

As indicated above, random or block copolymer adducts are effective. Examples of blocks which are effective are:

$-R^4-EO-PO-H$ $-R^4-PO-EO-H$ $-R^4-PO-EO-PO-H$ where each EO or PO block contains at least three alkylene oxide units.

Total values of m plus n are preferably from 10 to 45, more preferably 15 to 35. It is advantageous, to reduce coking, that individual ethylene oxide blocks have 10 ethylene oxide units or less in each block.

The choice of optional additional emulsifier (C) depends upon the lubricant selected. Especially suitable are fatty alcohol ethoxylates and alkyl phenol ethoxylates.

The emulsifier system which can be a single component or a mixture of ethoxylates, is chosen on the basis of hydrophobe lipophile balance for the lubricant/antistatic system in question.

The antioxidant system (D) may be any one which is compatible with the other materials selected from, for example, phenolic, amine or phosphite systems or mixtures thereof.

In use the compositions described are diluted with water, typically to give a final composition containing from 1 to 30% by weight of the total weight of effective ingredients A and B and when present C and D. The diluted composition is applied to yarns of fibres by conventional means. A typical application rate of the undiluted mixture is 0.1 to 1.0% of the weight of yarn being treated.

The invention is illustrated by the following examples.

EXAMPLES

Firstly, there is described the preparation of the antistatic agent which gives low coking properties. The reactions are given stepwise, starting from diethylaminoethanol.

Method of production of amine alkoxylates

Dialkylaminoethanol is reacted with ethylene oxide or propylene oxide or a mixture of the two by standard methods using potassium hydroxide (0.1–0.3% by weight based on the weight of product) as catalyst. Ethylene oxide addition is carried out at 140°–150° C. at 35–40 lbs/sq. in and propylene oxide addition at 120°–130° C. at 35–40 lbs/sq. in, pressure.

The block copolymers were prepared by conducting the two general reactions in the necessary order and combination.

Random copolymers were prepared by reacting the alkylamino alcohols with a mixture of ethylene oxide and propylene oxide at 120°–130° C. at 35–40 lbs/sq. in.

Conversion to dialkyl sulphate quaternaries

The amine alkoxylate together with 1% by weight of sodium carbonate is stirred at room temperature. The calculated amount of dialkyl sulphate is added dropwise with stirring over about 45 minutes. An exothermic reaction takes place and the temperature is allowed to rise to 45° C. Reaction is then completed by stirring for a further 18 hours at 55°–60° C. Quaternary strength is then determined by tritration against standard dioctyl sulphosuccinate solution and the product is then separated from sodium carbonate and sulphate.

The general method described above is exemplified by the preparation of a block copolymer of ethylene oxide (10 units) and propylene oxide (10 units) based on diethylaminoethanol and subsequent quaternisation with dimethyl sulphate.

| Materials | Mol. Ratio | Wt |
|---|---|---|
| Diethylaminoethanol | 1.0 | 175 g |
| Ethylene oxide | 10.0 | 657 g |
| KOH | | 0.8 g |

The diethylaminoethanol is charged to the reactor, stirring is commenced and the potassium hydroxide catalyst charged.

Reactants are dried at 100° C. by heating under a vacuum of 5–10 mm Hg with a stream of nitrogen passing through the reaction for 1.5 hrs. The reaction is then heated to 140° C. at atmospheric pressure and the ethylene oxide feed started. Addition of ethylene oxide is then continued at 140°–150° C. at 35–40 lbs per sq. in until after about 5 hours the required weight of ethylene oxide has been added. After allowing the pressure to run down for 30 mins at 140°–150° C. the reaction is cooled to 50°–60° C., purged with nitrogen and the product which is a dark amber liquid is discharged from the reactor. Yield of ethylene oxide copolymer: 832 g.

Conversion to EO/PO block copolymer

| Materials | Mol. Ratio | Wt |
|---|---|---|
| Diethylaminoethanol EO polymer | 1.0 | 400 g |
| Propylene oxide | 1.0 | 416 g |
| Potassium Hydroxide | 0.3% on Wt of product | |

The diethylaminoethanol EO polymer as prepared above and potassium hydroxide are charged and dried at 100° C. for 1.5 hrs as in stage 1 above. The reaction mixture is then heated to 120° C. and propylene oxide addition started. Propylene oxide addition is then continued at 120°–130° C. at 35–40 lbs/sq. in until the required weight of propylene oxide has been added (about 2,5 hrs). Pressure is allowed to run down at 120° C. for 1 hr before the reaction is cooled to 50°–60° C., purged with nitrogen and the dark amber product discharged from the reactor. Yield of EO/PO copolymer: 816 g.

The product may be converted to a block copolymer with twice the number of propylene oxide units as follows:

Preparation of diethylaminoethanol + 10 EO + 20 PO

| Material | Ratio | Wt |
|---|---|---|
| Diethylaminoethanol + 10 EO + 10 PO from previous preparation | 1.0 | 300 g |
| Propylene oxide | 10.0 | 153 g |
| Potassium Hydroxide | 0.2% on Wt of product | 0.9 g |

The diethylaminoethanol + 10 EO/10 PO and potassium hydroxide are charged and then the process of the previous propylene oxide reaction was repeated.

The yield was 453 g of amber liquid.

Quaternisation of diethylaminoethanol + 10 EO + 20 PO with dimethyl sulphate

| Material | Ratio | Wt |
|---|---|---|
| Diethylaminoethanol + 10 EO + 20 PO | 1.0 | 80 g |
| Dimethyl sulphate | 1.05 | 6.1 g |
| Sodium carbonate | 1% by Wt on amine | 0.8 g |

Diethylaminoethanol + 10 EO + 20 PO and sodium carbonate charged to a four necked flask fitted with stirrer, thermometer, condenser and dropping funnel.

The condenser and funnel are connected to a ventilation chimney. Agitation is started and with stirring at room temperature the calculated amount of dimethyl sulphate is added. dropwise over 45 mins.

During the addition the temperature is allowed to rise reaching about 45° C. by completion. When the addition is complete the temperature is raised to 55°-60° C. over ½ hr and the reaction completed by stirring at this temperature for a further 18 hrs.

A sample of product when titrated against standard sodium dioctylsulphosuccinate solution has a quaternary methosulphate strength of 95%.

The product is then filtered to remove residual sodium carbonate and sulphate.

Application to fibre: assessment of static properties and assessment of heat stability Heat Stability Quaternary ammonium derivatives of long chain tertiary amines have been found to be effective antistatic agents for use in spin finish formulations for synthetic fibres. Products such as the methosulphate and ethosulphate of the 20 mol ethoxylate of soya amine ($C_{18}$ amine) have found commercial outlets for this application. These products possess the advantage over the equally efficient anionic phosphate antistatics in that unlike the latter they do not accelerate wear of metal surfaces in use. While being good antistatic agents however these products can produce coke like deposits in significant amounts on being subjected to prolonged heating above 200° C. This tendency to coke has limited their use where high temperature (200°-235° C.) operations such as texturising are carried out. Any deposits under these conditions should be minimal if machinery shut downs and loss of first quality yarn production are to be avoided.

A laboratory method for the assessment of the level of contamination produced by a particular spin finish component or spin finish has been developed.

The test procedure involves heating a known weight of each product at 230°-5° C. for 24 hrs in aluminium trays, weighing the amount of residual coke and expressing it as a percentage of original weight of the product.

Coking properties of the quaternary antistatics were evaluated in this way and the coking properties of actual spin finish with antistatic were also tested.

In this way it was possible to grade the antistatics on their coking performance.

A range of products suitable for use as component D of spin finish oils according to the invention were prepared and their coking properties tested according to the above method.

In the following table of results

DEAE=diethylaminoethanol

DMAE=dimethylaminoethanol

EO/PO=ethylene oxide/propylene oxide.

the numbers of molecules and the state of polymerisation (random or block) is indicated.

The last two materials listed are known products included for comparative purposes.

| No | Component D | Quaternised with | % Coke |
|---|---|---|---|
| 1 | DEAE + 9E0/9PO(Random) | Dimethyl sulphate | 15.7 |
| 2 | DEAE + 10EO | " | 23.1 |
| 3 | DEAE + 10EO/10PO(Block) | " | 10.9 |

-continued

| No | Component D | Quaternised with | % Coke |
|---|---|---|---|
| 4 | DEAE + 10EO/20PO(Block) | " | 8.7 |
| 5 | DEAE + 2PO/10EO/20PO(Block) | " | 10.1 |
| 6 | DEAE + 21PO | " | 9.0 |
| 7 | DEAE + 10EO/5PO(Block) | " | 13.7 |
| 8 | DMAE + 10EO/20PO(Block) | " | 9.7 |
| 9 | Soya amine + 20EO(Block) | " | 26.5 |
| 10 | Soya amine + 20EO | Diethyl sulphate | 26.0 |

As can be seen the derivatives containing propylene oxide represent considerable improvement in coking performance over the conventional fatty amine types.

Samples of these components were incorporated in an ester based or mineral oil based spin finish. Parts are by weight.

| Example 1 - Ester based | |
|---|---|
| Isooctyl etearate | 50 parts |
| Oleyl/cetylalcohol + 6 EO | 30 parts |
| Antistatic Agent | 5 parts |
| Topanol CA | 1 part |
| Polygard | 1 part |

| Example 2 - Ester based | |
|---|---|
| Tridecyl Stearate | 50 parts |
| Oleyl/cetyl alcohol + 6 EO | 30 parts |
| Antistatic Agent | 5 parts |
| Topanol CA | 1 part |
| Polygard | 1 part |

| Example 3 - Mineral oil based | |
|---|---|
| Fabricol PBD | 50 parts |
| Oleyl/cetyl alcohol + 6 EO | 30 parts |
| Antistatic Agent | 5 parts |
| Topanol CA | 1 part |
| Polygard | 1 part |

The compositions (5 parts) were each diluted with deionised water (95 parts) to give the spin finish emulsions which were then applied by metering to undrawn polyester yarn to deposit 0.5% diluted emulsion on the yarn. The yarns were drawn and after conditioning overnight, their dynamic static properties were measured after passing over a glass pin at 60 meters/min. at (a) room temperature (b) after passing over a hot plate at 200° C. for 1 sec., using a Davenport electrostatic field meter. Additionally the resistivity of the yarns was measured. The standard of comparison in these tests was the quaternised ethoxylated soya amine listed above, incorporated in the spin finish compositions, at the same concentration as the samples under test.

Typical examples of coking of spin finish compositions

| | 1 | 2 |
|---|---|---|
| Fabricol PBD (Mineral Oil) | 50 parts | 50 parts |
| Oleylcetyl + 6 EO | 30 parts | 30 parts |
| Component D: No 10 (comparative) | 5 parts | / |
| Component D: No 3 | / | 5 parts |
| Topanol CA | 1 part | 1 part |
| Polygard | 1 part | 1 part |

-continued

| | 1 | 2 |
|---|---|---|
| Coke test results | 1.8% | 0.9% |

Results of assessment of static properties

| Antistatic (Component D) | Lubricant Base | Static* Properties (a) | Static* Properties (b) | Resistivity measured at 18° C. and 44% relative humidity |
|---|---|---|---|---|
| No 10 | Ester Base 1 | + 30 | + 40 | $8.9 \times 10^8$ |
| No 9 | " | + 20 | + 20 | $5.0 \times 10^8$ |
| No 4 | " | + 35 | + 50 | $6.5 \times 10^8$ |
| No 10 | Ester Base 1 | + 35 | − 2.5 | $6.78 \times 10^8$ |
| | Ester Base 2 | + 30 | + 5 | $1.5 \times 10^8$ |
| No 5 | Ester Base 1 | + 30 | + 5 | $6.73 \times 10^8$ |
| | Ester Base 2 | + 15 | + 15 | $2.4 \times 10^8$ |
| No 6 | Ester Base 1 | − 50 | + 42.5 | $9.56 \times 10^8$ |
| | Ester Base 2 | + 30 | + 5 | $1.5 \times 10^8$ |
| No 8 | Ester Base 1 | − 60 | − 70 | $6.95 \times 10^7$ |
| No 4 | " | − 60 | − 40 | $6.31 \times 10^7$ |

The results demonstrate that the derivatives are as effective as antistatic agents as known materials whilst at the same time offering potentially much lower contamination of heater surfaces.

We claim:

1. A spin finish composition comprising (1) a lubricant selected from the group consisting of mineral oils, esters and copolymers of ethylene oxide, propylene oxide and mixtures thereof for spin finishes, and (2) an antistatic agent of the formula

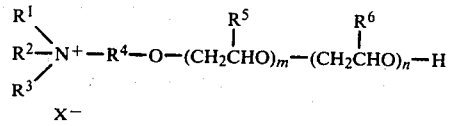

where:

$R^1$ and $R^2$, which may be same or different, are alkyl groups containing up to six carbon atoms;

$R^3$ is an alkyl group containing up to twelve carbon atoms;

$R^4$ is an alkylene group containing up to ten carbon atoms;

$R^5$ and $R^6$ are hydrogen or methyl;

m and n are integers from 0 to 60, provided that either m or n is at least 1 and where $R^5$ and $R^6$ are different, the poly alkylene oxide units are in block or random copolymer relationship and further provided that at least one propylene oxide unit is always present; and X is an anion.

2. A composition according to claim 1 in which there is present an additional emulsifier for aqueous emulsification.

3. A composition according to claim 1 or claim 2 in which there is present an antioxidant.

4. A spin finish formed by diluting a composition according to any one of claims 1 to 3 with water to form an emulsion containing from 1 to 30% by weight of the same composition.

* * * * *